US005740974A

United States Patent [19]

Conzelmann

[11] Patent Number: 5,740,974

[45] Date of Patent: Apr. 21, 1998

[54] YARN FEEDING DEVICE FOR A TEXTILE MACHINE, ESPECIALLY A KNITTING MACHINE

[75] Inventor: Fritz Conzelmann, Albstadt, Germany

[73] Assignee: SIPRA Patententwicklungs-u. Beteilungsgesellschaft mbH, Albstadt, Germany

[21] Appl. No.: 751,871

[22] Filed: Nov. 18, 1996

Related U.S. Application Data

[63] Continuation of Ser. No. 230,703, Apr. 21, 1994, abandoned.

[30] Foreign Application Priority Data

Apr. 21, 1993 [SE] Sweden ..... 9301315

[51] Int. Cl.[6] ..... B65H 51/00

[52] U.S. Cl. ..... 242/47.01; 66/146; 242/364; 242/417

[58] Field of Search ..... 242/47.01, 417, 242/364, 47.05; 66/132 R, 132 T, 146

[56] References Cited

U.S. PATENT DOCUMENTS

| | | | |
|---|---|---|---|
| 3,670,976 | 6/1972 | Vishiani | 66/132 |
| 3,720,384 | 3/1973 | Rosen | 242/47.01 |
| 3,820,731 | 6/1974 | Rosen | 242/47.01 |
| 3,883,083 | 5/1975 | Rosen | 66/132 |
| 3,995,786 | 12/1976 | Deniega | 66/132 |
| 4,106,713 | 8/1978 | Jacobsson | 242/47.01 |
| 4,114,823 | 9/1978 | Fecker et al. | 242/47.01 |
| 4,137,731 | 2/1979 | Jacobsson | 242/47.01 |
| 4,271,686 | 6/1981 | Memminger et al. | 66/146 |
| 4,271,687 | 6/1981 | Memminger et al. | 66/146 |
| 5,181,544 | 1/1993 | Deiuri | 242/47.01 |
| 5,211,347 | 5/1993 | Riva | 242/47.01 |
| 5,310,127 | 5/1994 | Deiuri | 242/47.01 |
| 5,323,625 | 6/1994 | Paggairo | 66/146 |

FOREIGN PATENT DOCUMENTS

| | | | |
|---|---|---|---|
| 2608590 | 9/1977 | Germany . | |
| 2743749 | 4/1979 | Germany . | |
| 147227 | 3/1981 | Germany | 242/47.01 |
| 4116497 | 11/1992 | Germany . | |
| 6-935543 | 4/1994 | Japan | 66/146 |
| 1262179 | 2/1972 | United Kingdom . | |
| 1295734 | 8/1972 | United Kingdom . | |
| 1444455 | 7/1976 | United Kingdom . | |
| 1531837 | 11/1978 | United Kingdom . | |

*Primary Examiner*—William Stryjewski
*Attorney, Agent, or Firm*—Michael J. Striker

[57] ABSTRACT

The yarn feeding device for a yarn-consuming textile machine includes a mechanism for positively feeding yarn to a textile machine according to predetermined yarn consuming speed changes and timings of those changes, this mechanism having a rotary yarn feeding element (1.83) carrying a main yarn reserve (84), a motor (82) for rotating the yarn feeding element (1.83) at a motor rotation speed according to the variable yarn consuming speed and a motor controller (51, 57) for controlling the motor; a yarn reserve device (3.78; 20, 77) for building up or reducing an auxiliary yarn reserve consisting of a portion of yarn extending between the main yarn reserve and the textile machine, when changes in the yarn consuming speed occur that are so rapid that the motor (82) temporarily cannot change the motor rotation speed to deliver yarn from the rotary yarn feeding element at the yarn consuming speed because of motor inertia; a controller for the yarn reserve device (3.78; 20.77) which increases or decreases the auxiliary yarn reserve so that, when the predetermined yarn consuming speed changes, the yarn is fed into the textile machine from the auxiliary yarn reserve at the yarn consuming speed of the textile machine in spite of the motor inertia.

14 Claims, 5 Drawing Sheets

YARN FEEDING DEVICE FOR A TEXTILE MACHINE, ESPECIALLY A KNITTING MACHINE

This is a continuation of application, Ser. No. 08/230,703, filed on Apr. 21, 1994, now abandoned.

BACKGROUND OF THE INVENTION

The present invention relates to a yarn feeding device feeder in a textile machine, which provides a yarn reserve on a rotary spool driven by a motor or motor arrangement. The yarn to be supplied by the yarn feeder to the machine within each specified time interval is known in advance by the yarn feeder control device. As part of the operating sequence which it performs in the textile machine, the yarn feeder establishes temporary yarn reserves which can be supplied to the machine. The motor or motor arrangement may be controlled so that the requisite quantity of yarn is available for delivery by the yarn feeder as a function of the product pattern and the machine speed. The invention also relates to a procedure associated with the yarn feeding device.

A knitting machine yarn feeder is normally one of two types which employ different principles of operation. The most common type is the 'positive feeder', in which a given quantity of yarn is supplied per machine revolution. Typical examples are the IPF (IRO Positive Feeder) made by IRO AB, Sweden (e.g. U.S. Pat. No. 3,720,384) and the MPF made by Memminger, Germany (e.g. DE-PS 26 08 590). This principle is reasonably satisfactory in operation provided that the yarn consumption is more or less constant, as when knitting plain goods. The principle of positive feed affords the highest knitting quality when the friction between the yarn and needle/sinker is of minor importance to the amount of yarn taken from previous loops to form the current loop.

The yarn demand varies in jacquard knitting of frotté and similar materials, in which the pattern is formed by knitting plain and raised goods alternately. In extreme cases, the yarn demand between a plain and a raised piece may vary by a factor of as high as 10. Until now, it has been considered impossible to alter the speed of the yarn or its rotary spool sufficiently quickly to match the variation in demand. In this case, the solution has been to use a yarn feeder employing an alternative principle, whereby the yarn tension is maintained constant. An example of this type of feeder is the SFT yarn feeder made by IRO AB and also disclosed in DE-OS 27 43 749.

Yarn feeders which incorporate both principles are also available (DE-OS 41 16 497).

The use of a pivoting arm which interacts with the outgoing strand of yarn from the yarn reserve is a known feature of a yarn feeder. However, the arm is spring-loaded and connected to a position sensor, the output signal from which is used to control the yarn feeder motor so that it delivers yarn in such manner that the arm is maintained at a fixed angle. Thus, the known yarn feeder employs the constant tension principle and cannot be used in the present application. At present, it is not physically possible to use a spring-loaded arm of this type since the mass of the arm cannot be made sufficiently low.

In some cases, the yarn feeder is required to operate at a constant rate of yarn delivery from the rotary spool. The problem is that all existing motors possess a certain, relatively high moment of inertia, which limits the rate at which the speed can be increased or decreased since the available power is limited. A needle and a sinker in an actual textile machine can change speed very quickly since the components are extremely light and are guided by a slot in the stationary part of the machine, whereas the moving parts comprise part of the heavy, rotating part of the machine. The difference in power demand required to make the needle and sinker perform small or large movements is negligible.

SUMMARY OF THE INVENTION

It is, therefore, an object of this invention to provide a yarn feeder as above specified which avoids the problems mentioned above.

A further object of this invention is to provide a yarn feeder without a spring-loaded arm of the type mentioned above.

A further object of this invention is to provide the yarn feeder with means which over-come delays in motor operation which are necessary if a change of yarn consumption occurs.

Yet another object of this invention is to provide a control means for the yarn feeder for accomodating rapid changes in yarn speed.

Yet another object of this invention is to provide a method of operating a yarn feeder in such a manner that abrupt changes in yarn speed are possible.

These and other objects are attained in accordance with this invention with a yarn feeder and a method of operating same wherein the yarn feeder, in order to supply yarn from the main yarn reserve in accordance with the constant yarn flow principle, is provided during changes in the yarn consumption and speed of the machine of such rapidity that the motor or motor arrangement feeding yarn from the main yarn reserve is unable to keep pace. The yarn feeder and the yarn reserve a gathering unit may, in some cases, operate in accordance with the constant yarn tension principle during at least part of the rapid changes.

In one embodiment, a motorized arm of small mass is used as part of the yarn reserve means. During periods of low yarn consumption, the arm occupies a first position in which the yarn feeder operates as a positive feeder. When the yarn consumption changes to a high level, the motor is accelerated and the arm is moved inward to a second position, in which the small yarn reserve is consumed as the motor assumes the correct speed.

When changing from a large to a small yarn demand, the arm takes up the surplus yarn by moving towards the second position as the motor is braked. Other variants of the operating pattern may be included. Operating the arm to a third position prior to the change in speed enables the auxiliary yarn reserve to be established prior to an increase or after a decrease in demand. During a period of steady demand, this yarn reserve is used as the arm swings inward. Also characteristic of the embodiment is that the arm is controlled by means of a dedicated yarn reserve motor and that its position is detectable by means of a position detector. The pivoting element or arm may be supported in a bearing at a point of intersection of two tangents or chords extrapolated at right angles to each other from the yarn reserve surface of the spool. The pivoting element or arm thereby extends beyond parts of the spool end to a greater or lesser extent.

To establish a yarn reserve of approximately 45 mm, the pivoting element requires an acceleration of 14000–15000 radians/$s^2$ which, depending on the type of motor, may deliver a torque of 0.05 Nm.

An alternative embodiment of the yarn reserve means employs an armless arrangement employing, for example, a brush ring disposed at or on the rotary spool of the yarn feeder. The motor speed is increased prior to an increase in consumption, during which period the brush ting acts in the same manner as in the constant tension type of yarn feeder. The yarn reserve is wound onto part of the spool periphery since the spool delivers more yarn than the needles of the machine can use. When the needles consume more yarn than the quantity which can be delivered at the prevailing spool speed, the additional amount is taken from the 'extra loop' or an auxiliary yarn reerve stored on the brush ring. The opposite occurs during a transition to low consumption: When the spool delivers more yarn than the needles can use, an 'extra loop', which is subsequently consumed as the motor is braked, is formed. In some cases, the motor may be required to perform a minor overshoot during braking. The brush ring version may be considered as comprising a number of small arms which also act as springs, ensuring the satisfactory overall function of the embodiment. In the brush ring version, if the outgoing strand of yarn becomes slack, the yarn remains taut on the yarn support surface condition as an extra part turn of the reserve remaining on the surface. The part turn should preferably occupy less than 270°.

In an alternative embodiment, the product pattern or production sequence is either programmed or programmable in a computer unit, which may consist of a master control unit for the textile machine and may also be assigned to control the operating sequence of the yarn feeder. The computer unit is designed to generate function control commands which impart acceleration or retardation, as well as any necessary intermediate speed changes, to the motor or motor arrangement as required by rapid changes in yarn consumption in the textile machine.

In one embodiment, yarn reserve means with its pivotally mounted element or arm is controlled by the computer unit or a separate computer unit, based on information regarding the imminent yarn consumption.

On/off motor control is feasible in one motor control embodiment. The motor is switched on when the minimum limit of the yarn reserve is reached and runs continuously until the maximum limit is reached, at which point the motor is stopped.

In a proposed embodiment, the yarn feeder outfeed eye is mounted at an offset in the direction of the center of the knitting machine to minimize the resetting angle when yarn is unwound from the rotary spool or spool body.

The significative method of the invention may be regarded principally as being characterized by the fact that a yarn reserve gathering unit or means for temporarily strong yarn in an auxiliary yarn reserve and for delivering the yarn from it is controlled or disposed so that, despite the rapid changes in speed, the yarn supply is effected in accordance with the constant yarn flow principle, interspersed only occasionally, as required, by brief periods of operation in accordance with the constant yarn tension principle. Among other things, refinements of the method take cognizance of the fact that the control of the yarn reserve means gathering unit is such that the yarn gathering and supply functions are effected at or from the rotary spool when the yarn demand differs from that corresponding to the prevailing speed of the motor or motor arrangement. The motor or motor arrangement is controlled by a predictive control unit or computer unit in the textile machine, which unit varies the speed of the motor arrangement at least mainly as a function of the yarn consumption.

The invention affords a versatile, dedicated yarn feeder motor drive arrangement, while ensuring that a satisfactory yarn feed function, essentially of the constant yarn flow type, is achieved. The system may incorporate control functions capable of employing a predictive method of supplying the correct quantities of yarn to the machine at the correct instant of time. The yarn feeder facilitates work on the knitting machine or equivalent machine. The yarn feeder can operate in combination with the yarn reserve means using predictive control commands from a control unit or computer unit. The proposed system affords a yarn feed function which is close to ideal. The changeover control functions are suited to 'fuzzy logic' and/or neural network functions.

This creates a need to accelerate or brake the motor prior to an imminent change in yarn demand so that it assumes, as soon as possible with regard to its design and the power available, a speed corresponding to the desired yarn demand. Among other things, the invention solves this problem.

To solve the problem of overcoming delays in motor operation, the exemplified embodiment employs a unit, in the form of an arm, which extends the path of travel of the yarn. Among other things, the problem is solved by the fact that the arm is light and is driven by a motor only through an extremely limited angle. Motors of this type are typified by the units used to position the reading head in a disk storage unit. In the invention, the problem is solved by more exact specification of the design and operation of the arm. The invention also proposes an alternative solution which does not employ an arm. A brush ring is disposed at or on the rotary spool and the yarn feeder operates, in this case, only for short transitional periods in accordance with the 'constant tension' principle. In the invention, the problem is solved by the use of such a ring for this purpose.

The present invention also solves the problem of providing the yarn feeder with an individual drive. This is achieved by means of a motor or motor arrangement (which may comprise one or more motors).

The use of an individual motor drive calls for a relatively advanced method of control of the motor or motor arrangement. This method must be capable of accommodating rapid changes (accelerations and decelerations) in the yarn speed. Operating sequences in textile/knitting machines are rapid and changes in motor speed must be feasible. As a complementary or alternative measure, a yarn feed which is incapable of accommodating the changes in speed of the motor arrangement, or vice versa, must be modified in an appropriate manner to ensure an efficient supply of yarn. This problem is also solved by the invention.

In one embodiment, signals which predict or commands which control the yarn feed are generated so that changes in motor speed are coordinated with the anticipated or desired yarn feed function. In accordance with one embodiment, the yarn demand is predicted using details of the pattern or design of the finished product made by the machine. The invention also proposes a signal or control command generation based on information from the pattern or similar source.

Means of generating control commands when using predictive devices are essential. The invention, therefore, proposes that a control computer should be used to provide or utilize information regarding the immanent yarn consumption and should use this information to establish control commands or signals. Further, the invention proposes a processing method designed to achieve a purpose-designed command or signal function.

BRIEF DESCRIPTION OF THE DRAWING

The objects, features and advantages of the present invention will now be illustrated in more detail by the following detailed description of preferred embodiments, reference being made to the accompanying drawing in which.

DESCRIPTION OF THE PREFERRED EMBODIMENTS

Figure 1:
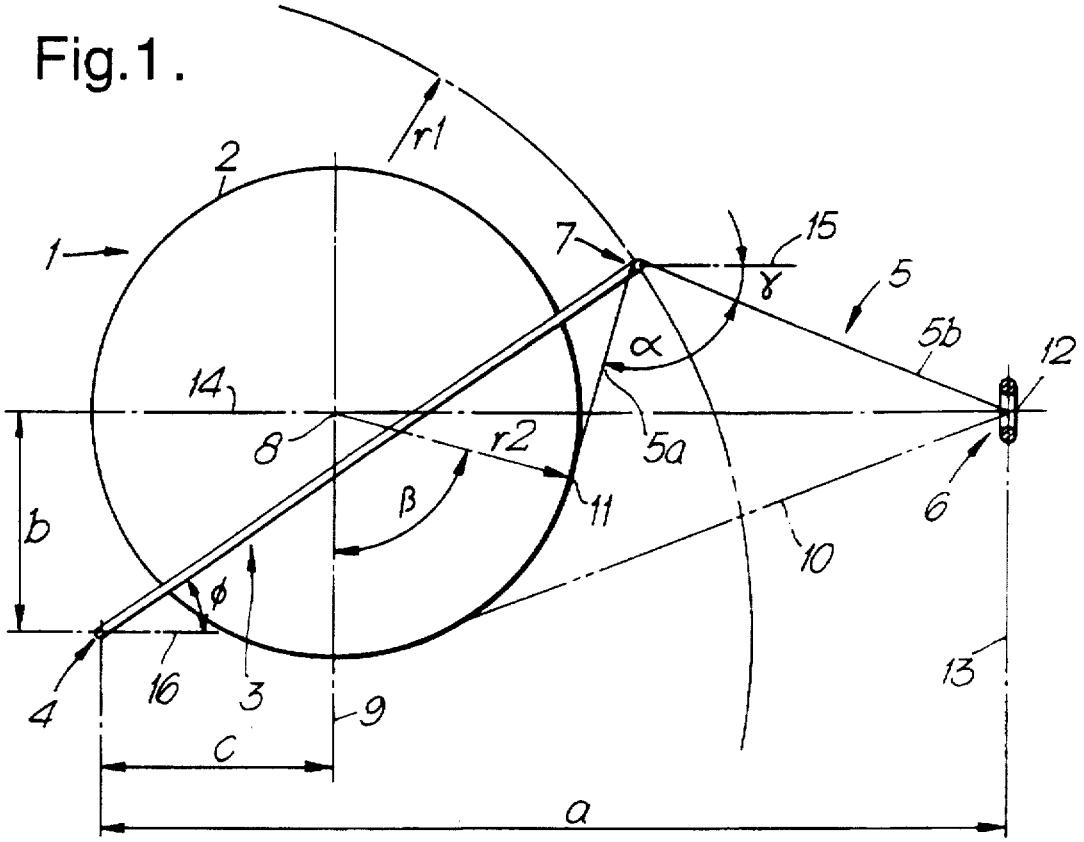
FIG. 1 is a diagrammatic side view of one embodiment of the yarn feeding device according to the invention including a rotary spool with a yarn support surface and a yarn gathering arm of a yarn reserve unit associated with it.

The yarn feeding device illustrated in FIG. 1 includes a rotary spool body having a yarn support surface 2 on which a main yarn reserve is stored. This embodiment of the yarn feeding device according to the invention has a yarn gathering or yarn reserve means including a pivotally mounted element, which in this embodiment is a pivotally mounted arm 3. The arm is movably supported in a pivot mounting 4. The outgoing strand of yarn is denoted 5, the yarn being delivered through an outfeed unit or eye 6. At the end of the arm opposite to the pivot mounting 4, the arm is provided with an angled section 7, by means of which the arm 3 is enabled to interact with the outgoing strand of yarn. The radius of action of the arm 3 is represented by r1 and the center of rotation of the spool body 1 by 8. A vertical line or plane through the axis of rotation 8 is designated 9. A strand of yarn which is not influenced by the arm 3 is represented by the broken line 10.

In the figure, the pivoting arm 3 is shown in interaction with the outgoing strand of yarn, positioning the sections of yarn 5*a* and 5*b* at an angle. The section of yarn 5*a* unwound from the surface 2 leaves the surface 2 tangentially at point 11. The central portion of the eye 6 is denoted by 12. A distance between the pivoplane 13 through the arm and a plane 13 through the eye 6 is denoted by a. A distance between the pivot mounting 4 and a horizontal plane 14 is denoted by b. A distance between the pivot mounting 4 and the vertical plane 9 is denoted by c. In the present instance, the chosen value of a is approximately 80 mm. Distance b is equal to distance c, both being approximately 22.5 mm. Furthermore in FIG. 1, the angle between the yarn sections 5*a* and 5*b* is denoted by $\alpha$, and the angle between a radius r2 extending from the center of rotation 8 of the spool to the tangential point 11 is denoted by $\beta$. In addition, an angle 2 is contained by the yarn, section 5*b* and a plane 15 parallel to the horizontal plane 14. It is clear that these angles vary with the pivoting arm angle $\phi$, which is the angle between a horizontal plane 16 parallel to the horizontal plane 14 and the arm. The pivoting arm is of a small mass, typically 2 grams.

Figure 2:
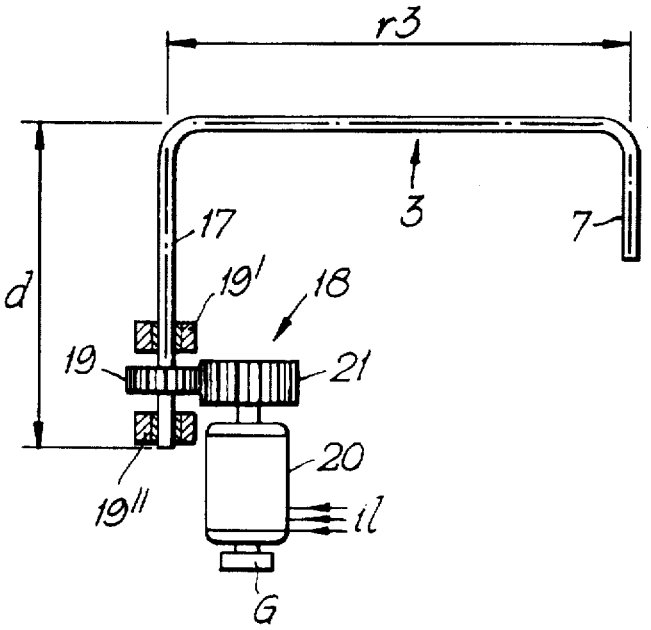
FIGS. 2 and 2*a* are, respectively, top and front diagrammatic views of the yarn gathering arm shown in FIG. 1.
Figure 2A:
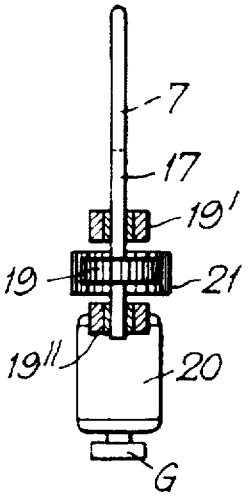

In FIG. 2, the radius of the arm is represented by r3. In the present instance, the chosen value of the radius is 60 mm. The length of section 7 is approximately 20 mm. The length d of the support and drive spindle 17 of the arm 3 is approximately 40 mm in the present instance. The chosen diameter of the various sections of the pivoting arm is 1.5 mm. A drive arrangement for the pivoting arm is shown in principle by 18, and consists of a gear 19 mounted on the arm and driven by a drive gear 21 mounted on a motor 20 or equivalent drive means. The beating device for the arm is denoted by 19' and 19".

Figure 3:
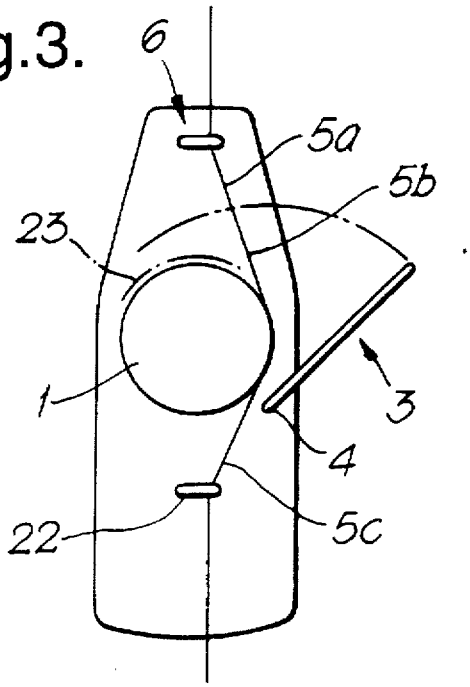
FIGS. 3, 3*a* and 3*b* are diagrammatic side views of the yarn reserve unit shown in FIGS. 1 to 2*a* in various stages of operation.
Figure 3A:
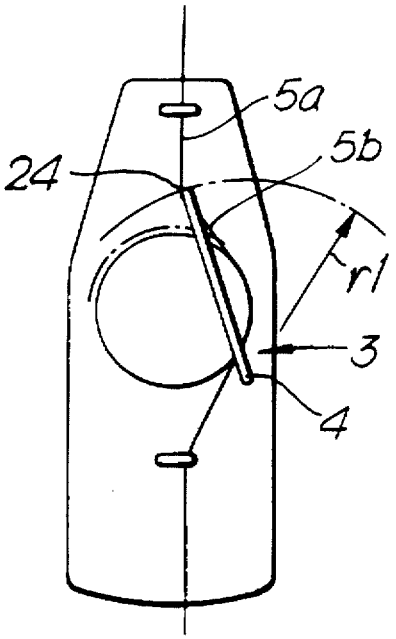
Figure 3B:
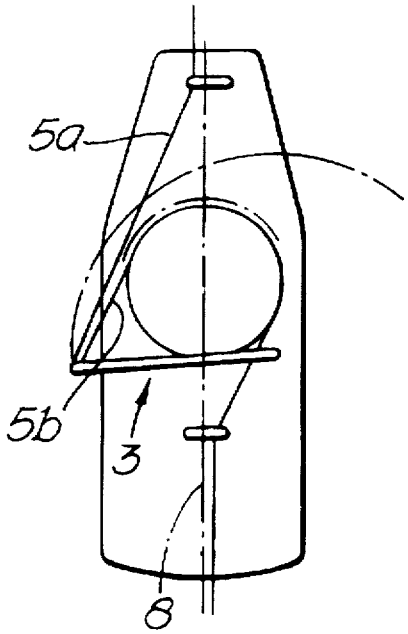

Three operating stages of the pivoting arm 3 are shown in FIGS. 3, 3*a* and 3*b*. In FIG. 3, the arm is positioned fully to the side, clear of the sections of yarn 5*a* and 5*b*. The yarn 5*c* is wound onto the yarn support surface of the spool 1 through an eye 22, forming a number of turns 23 on the spool. The spool may exhibit yarn separating devices in the form of rod-shaped elements of an inherently known type. In the operating stage illustrated in FIG. 3*a*, the pivoting arm 3 is shown in interaction with the yarn at point 24, extending the path of the yarn 5*c*, 5*b* and 5*a*, which extension is utilized as a store in which an auxiliary yarn reserve which is surplus to the prevailing yarn supply situation can be stored. In the situation illustrated in FIG. 3*b*, interaction with the yarn has been increased so that the yarn path is longer, the pivoting arm assuming a position in which it is essentially at right angles to the longitudinal axis of the yarn feeder. The arm is mounted at an offset with respect to the axis of rotation of the spool 1. In one embodiment, the pivot mounting 4 (cf. FIG. 1) is located in the essential proximity of two tangents extending through the aforementioned vertical and horizontal planes 9 and 14 respectively. The pivot mounting 4 may also be considered to be located at the point of intersection between two chords parallel to the vertical and horizontal planes 9 and 14 respectively. Control of the arm is achieved by means of control commands i1 (cf. FIG. 2), which actuate the arm drive device. The control commands i1 may be supplied by a computer unit as described below. The extension of the yarn path effected by the arm is about twice the length of the arm. When required by the yarn feed, yarn from the yarn store created by the extension of the yarn path may be released by means of modified control commands i1. Thus, for example, the arm may be made to assume, to a greater or lesser degree, various positions intermediate to those shown in FIG. 3 and FIG. 3*a*.

Figure 4:
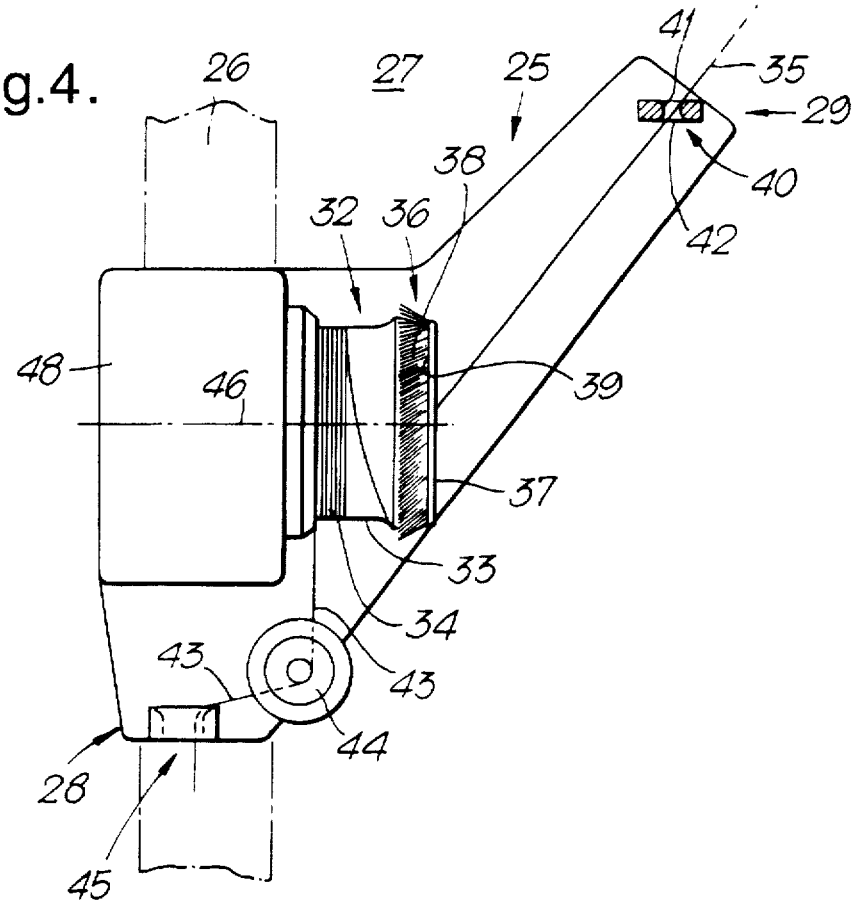
FIGS. 4 and 4*a* are diagrammatic views of a second embodiment of a yarn reserve device according to the invention.
Figure 4A:
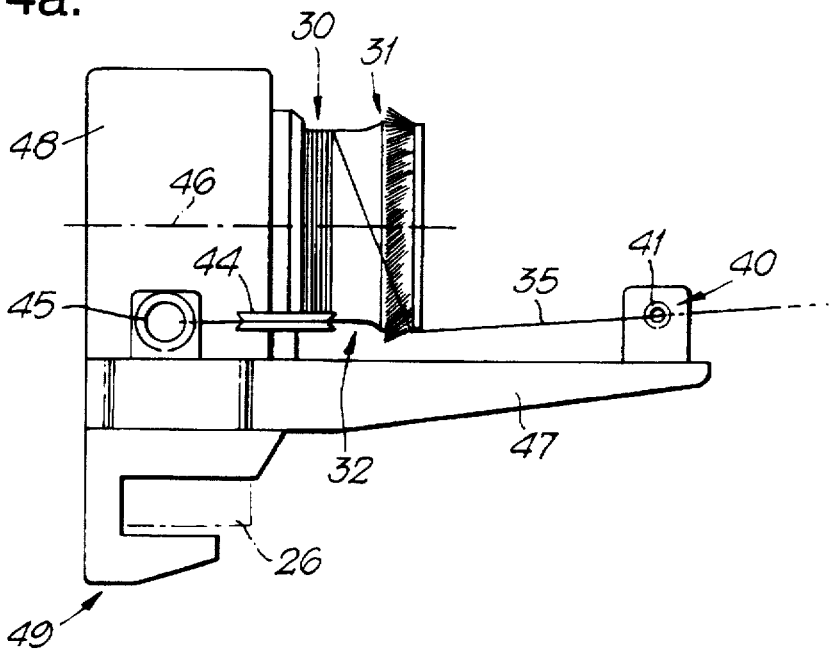

Whereas the embodiment according to FIGS. 1–3*b* is considered to be the best one up to now, FIGS. 4 and 4*a* show a further embodiment without arm 3. In FIGS. 4 and 4*a*, a yarn feeding device is denoted by 25. The yarn feeding device is suspended from a frame section 26 of the particular textile machine or knitting machine 27. The yarn feeder infeed side is denoted by 28 and the outfeed side by 29. The yarn feeder is mounted vertically, the yarn being admitted at upper parts 30 and discharged at lower parts 31. The yarn support spool is denoted by 32 and the upper and lower parts 30 and 31 refer to positions on the spool. The spool consists of a number of rodshaped elements or pins arranged in the longitudinal direction of the yarn feeder, forming a yarn turn separation means which operates in an inherently known manner and will not, therefore, be described in detail here. Further, all other known systems may be used which guarantee proper movement and separation of the yarn turns. A number of turns of yarn 34 the main yarn reserve is wound onto the yarn support surface 33. The outgoing strand of yarn 35 passes a friction device 36 which, in the present instance, consists of a brash arrangement incorporating a ring 37 and brash elements 38 extending in parallel from it, which arrangement is formed in an inherently known manner. The brush elements are, in principle, sprung and trail against a surface or periphery 39 at the yarn outlet end of the spool. By virtue of their spring action, the brush elements bear against the surface 39 with the strand of yarn 35 running between. Thus, the strand of yarn runs between the ring 37 and is pressed against the surface 39 by the brush arrangement. The strand of yarn 35 runs further from the brush arrangement to an outlet eye 40, in which a ring 41 made of ceramic or other wear-resistant material is fitted. The recess for the eye is denoted by 41. The incoming yarn path is also illustrated in FIG. 4*a*. The strand 43 runs from a storage reel, which is not shown, and is guided through an inlet eye 45 of the same type as the aforementioned eye 40, over an idler pulley, and is then wound around the periphery of the surface 39. The strand of yarn between the outgoing turn and the brush assembly is maintained in constant tension by this arrangement. At yarn supply speeds such that the spool cannot be accelerated in sufficient time, an auxiliary yarn reserve is established in the form of extra turns which remain on the spool. Conversely, if the spool cannot be decelerated in sufficient time, yarn is taken from the yarn reserve. This arrangement may also be regarded as an extension or shortening, as applicable, of the yarn path for the purpose of ensuring an efficient supply of yarn at every instant in time for production of the particular stitch, while preventing snagging of the yarn.

In the plan view shown in FIG. 4, the direction of withdrawal of the strand of yarn 35 is essentially normal to the brushes 38 in the brush arrangement 37. The incoming strand of yarn 43 is wound onto the yarn support surface 33, essentially at right angles to a plane extending at right angles to the plane of the figure through the axis of rotation of the spool 46. The arrangement 40 is positioned at an angle to the longitudinal direction of the strand of yarn 35. The first and second frame sections are denoted by 47 and 48 respectively. The yarn feeder is mounted in position by means of the bracket 49.

Figure 5:
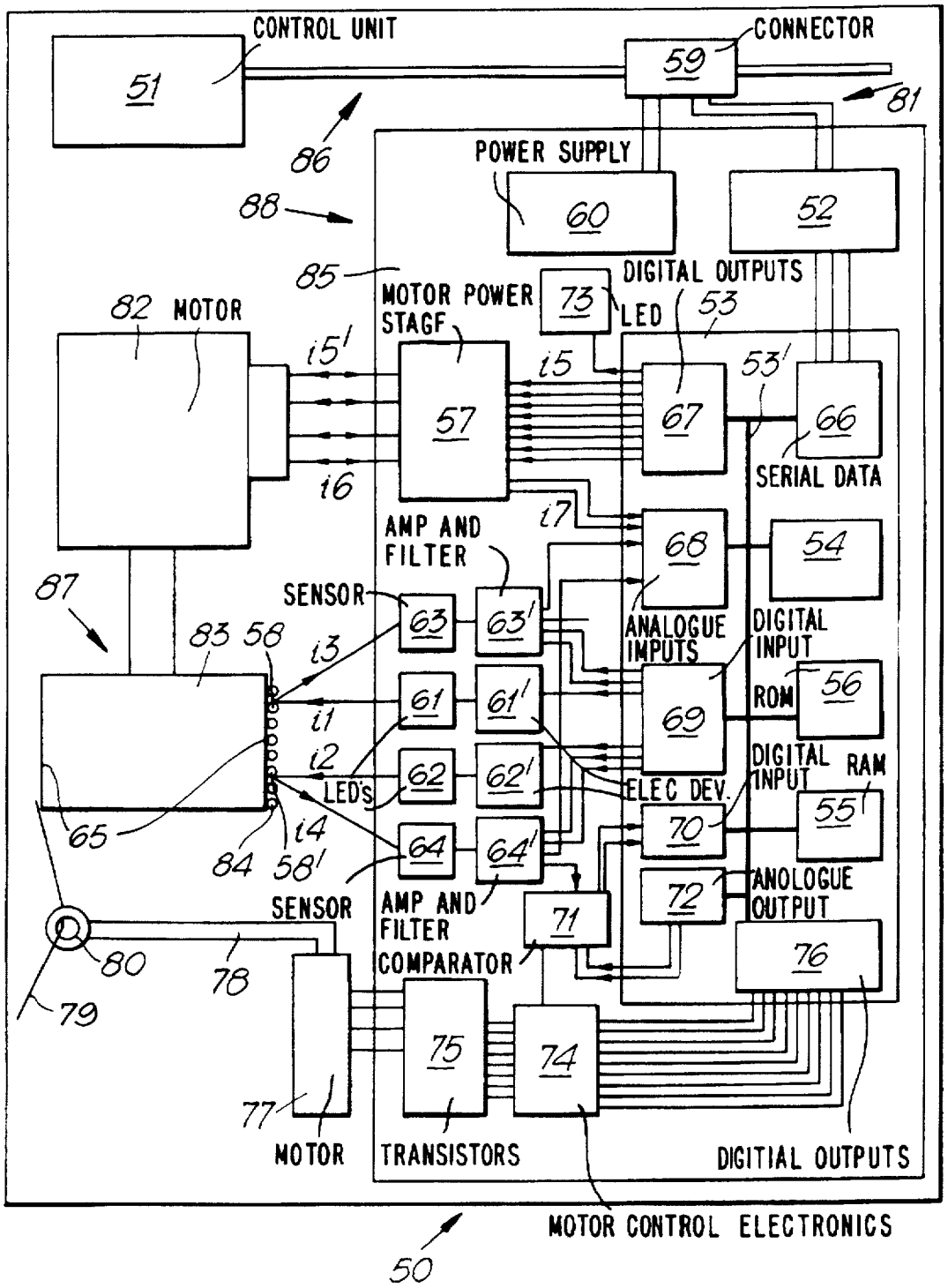
FIG. 5 is a block diagram of a control device for the yarn feeding device according to the invention shown together with components of the yarn feeding device.

In accordance with FIG. 5, the equipment described is housed in an enclosure 50. A control unit 51, which may either be included or may comprise part of the textile machine, is used to control the yarn supply to the knitting unit as determined by a control command stored in a mass storage memory of the hard-disk type. The yarn feeder should be capable of delivering the exact quantity (length) of yarn to be used in the finished product. The desired length of yarn is specified on the basis of information stored in the knitting machine memory (in control unit 51 ).

The invention is based on the use of an efficient microprocessor, fast, efficient data communication and a fast motor. The motor may consist of an inherently known type of a.c. motor, a PM (permanent magnet) motor etc., and may, if appropriate, be included with another metor as part of a motor arrangement which, in addition to one or more motors, also includes the associated control arrangement (se also below).

When knitting in different colors and with loops of different sizes, the knitting rate may be as high as 500 loops per second and the yarn consumption 1000 mm/s for small loops and 4000 mm/s for large loops. Under the same conditions, the average speed of the red strand is found to be 2286 mm/s and that of the green strand 2714 mm/s. The knitting machine control unit controls the knitting system so that the strand forms small or large loops and this information is available to the yarn feeder, which is designed to deliver the correct quantity of yarn to the knitting system which inserts the needle in the material. The yarn feeder must know when the loop is formed and how much yarn is to be used in the loop. The number of loop sizes is normally strictly limited, making it feasible to store a list of the sizes in which each size is identified, for example, by a number. In the course of knitting, the control system instructs the yarn feeder regarding which loop to use and when, in time, knitting should be performed. The time and operation can be synchronized using a time signal to set clocks or simply by sending a signal prior to the start of a new knitting cycle, that is 500 times per second in the example described above. The yarn feeder should, for example, supply 2 mm of yarn for each small loop and 8 mm for each large loop to be knitted. A small addition or subtraction may also be made each time the loop size is changed, due to the special yarn geometry which may prevail during the changeover period. Due to the properties of the material, this variation may differ during a change from 2 to 8 mm compared with a change from 8 to 2 mm; however, the difference is normally so small as to be negligible. The yarn feeder is supplied with information regarding the loop size (yarn consumption) in good time before the knitting system forms the loop in the material. In this context, 'good time' means a time of the order of 10 to 200 milliseconds, which means that the yarn feeder must store an internal list of 10 to 500 loops ahead of the knitting operation. This information is essential if the yarn feeder is to accommodate the rapid changes in yarn consumption which, in the foregoing example, may vary from 1 m/s to 4 m/s within 2 milliseconds.

The electronics according to the invention consists of a number of principal components/functions: Power pack, data communication and motor control in terms of speed and/or position. In some instances, it may be necessary to control two motors to achieve sufficiently rapid control. In most instances, yarn detectors are also provided to warn the system if the yarn should disappear for any reason. In FIG. 5, the rotary components of the yarn feeder are represented symbolically by 87 and the rotary spool which supports the auxiliary yarn reserve 84 by 83. The motor is represented by 82. The electronics are grouped on a mounting board 85. The electronics and equipment in the unit 88 must be connected to a unit which is programmed with complete information on how the material being knitted is composed of strands. This unit 51 is normally the control system which controls the knitting systems, since the basic information required for this purpose is the same as that required to control the yarn feeders. If the knitting machine is of a simple type with a fixed mechanical program, it must be equipped with a unit programmed with details of the system and with some means of synchronization with the mechanical system. This unit may then transmit control signals to each yarn feeder in good time. It is possible to connect the yarn feeder directly to the respective knitting system and to store the repetitive program directly in the yarn feeder. The yarn feeder may be equipped with a data communication interface by means of which the feeder may be adapted to operate with knitting machines of all types.

The connector 59 normally includes two power supply conductors and two data communication conductors between the unit 88 and the machine control unit 51. The bus 86, which carries both the power supply and the data communication conductors, is normally connected to all or some of the yarn feeders. The number of yarn feeders connected to one and the same bus is limited by the maximum power which the power supply lead can carry and how much data can be transmitted by the data communication system. Other reasons may make it desirable to divide the system into smaller sub-systems. If several buses are used, the unit 51 must be equipped with several connections for buses of the same type as 86. The unit 60 incorporates those components required to provide a satisfactory power supply to the various components of the unit 88. The power pack is of a design normally used when it is desirable to use a single type of supply, such as 24 V d.c., for the complete system. The type of supply is determined by the motor demand since this is the largest power consumer. A d.c. supply, at a voltage determined by the motor power demand, is suitable when the electronics are used to control the motor position and speed. Since the motor must be started and stopped very quickly, the power supply is provided with some means of energy storage of sufficient size to accommodate the increase or decrease in kinetic energy which occurs as the speed of the motor and yarn wheel is altered. This means normally takes the form of an electrolytic capacitor, although other means of electronic and/or electromechanical energy storage may be considered. The use of a d.c. supply to this type of yarn feeder is advantageous since excess energy can be returned to the supply. In the normal case, if the yarn consumption falls at one point, it must be increased at another yarn feeder, in which case most of the energy is transferred between the yarn feeders and the only energy which must be supplied is that required to make up the system losses. Although an a.c. supply could also be used if each unit were to incorporate a rectifier, it is less expensive to carry out conversion at central level so that the voltage obtained is directly suitable for the motor requirements. Unit 60 may incorporate some type of filter to suppress the effects of outside interference and conversely, to ensure that internal faults or disturbances cannot be transmitted through the supply lead and interfere with other units. In most cases, some form of voltage conversion is also provided to obtain a voltage suitable for the processors and analogue measuring system. All of these functions can be implemented using known technology.

In principle, the motor power stage 57 consists of a number of transistors, which connect the supply to the motor windings in a number of ways. In the case described, the motor used is provided with a rotor of magnetic material and with a stator with three windings. The number of magnetic poles in the rotor and the number of poles in the stator can be varied by means of technology which is known from the manufacture of this type of motor. The three windings may be regarded as interconnected at a common point and the stator has three leads, each of which is connected to a pair of transistors, so that the lead can be connected to the power supply earth i6 or the d.c. supply i5'. This supply to 57 is not shown in the figure since it is executed in a known manner. The type of transistor may vary; however, it is normally of the MOS type, although IGBT and bipolar transistors may also be used. In the instance described, the transistors are controlled either in the fully conducting or fully non-conducting mode. A transistor which possesses extremely low resistance when in circuit and is completely blocked when disconnected is used in the proposed embodiment. The transistor switching time is as short as possible in view of interference generation. A suitable choice in an application of this nature is a MOS N-type transistor which has an extremely high resistance (a leakage of less than 1 mA) when disconnected and a resistance of less than 0.1 ohm when in circuit. Although on/off control of these transistors can, in principle, be achieved by means of signals i5 directly from digital outputs, based on the software values, the signal levels are modified in many cases. Special drive circuits such as the IR2121 type by International Rectifiers, or others performing the same function, may also be used. Special drive circuits of similar type for motor control, such as the type ETD3002 by Portescap, are also available, reducing the demands on the microprocessor in terms of motor monitoring and control. Satisfactory motor control is possible in this application without monitoring the winding currents. However, current measurement provides an additional check, while improving efficiency and acceleration. Control can be improved in terms of speed regulation merely by measuring the total current in the windings. For positioning purposes, the current must be measured in at least two of the windings for full current control. In the simplest case, the current is measured by measuring the voltage drop across a known resistance. In FIG. 5, this voltage drop is denoted by i7 and is fed to the A/D converter for use in that area of the software which controls the motor current. The foregoing description is applicable to a three-phase motor with a magnetised rotor. It may be preferable to use a stepping motor in this application since it is desirable to achieve lengthwise feed of the yarn. A stepping motor is normally provided with only two coils; however, since these are connected in circuit independently of each other, four pairs of transistors as described above and two power supplies per coil are required in this case. The control of a stepping motor of this type is executed in a known manner. A P532 motor by Portescap is an inexpensive and fast type suitable for this application.

Control of the motor in the aforementioned arm 78 is, in principle, executed in the same manner as in the instance just described. Since the forces are lower, a motor for this purpose may be extremely small and the moment of inertia of the arm may be made correspondingly small, making the motor extremely fast in operation. This type of motor is known in the computer technology field, in which it is used to position reading heads in hard-disk drives. The motor for the arm 78 and yarn eye 80 is represented by 77 and may consist of a motor with magnets in the rotor and some means of stepping as a function of the stator winding current. This type may normally be controlled by one of a number of means of controlling the stator winding current, as described in the literature for this type of motor. The current is controlled by means of a number of transistors 75 which, in principle, are the same as those used for 57, with the exception that the power demand in the various components may differ. The transistors in 75 may be controlled directly by the processor digital outputs or with the aid of some form of motor control electronics 74.

Direct control of the yarn reserve is unnecessary with this type of yarn feeder since this function is controlled 100% by the feeder itself. However, since the yarn may, possibly, break or otherwise disappear from the feeder, the feed function will be lost and the knitting machine must be stopped. If the system is equipped with bidirectional data communication, the yarn feeder can transmit an emergency stop signal to the control system. If this signal is of a type which can be understood by all other yarn feeders, these may also be prepared for emergency stopping. Since the manner in which the machine will react to an emergency stop may be known in advance, the latter function may be performed in organized forms. If the emergency stop signal cannot be understood by other yarn feeders, the control unit may transmit one or more signals to other units to order emergency stopping. Alternatively, the control system may reduce the speed to zero in the same manner as under normal running conditions, in which case the other yarn feeders will be unable to distinguish between a normal and an emergency stop. However, this is not be necessary in many instances.

The sensor consists of simple, conventional electronic devices 61' and 62', which fire and extinguish the associated LEDs 61 and 62 by means of a digital control signal so that the light signals i1 and i2 can be activated and deactivated. The LED may be of a type which emits a visible light or a light of lower wavelength within the infrared range invisible to the eye. With the present type of yarn feeder, two points of measurement are sufficient to verify that yarn is both being taken up and delivered to the knitting system. In some cases, an additional optical sensor may be required to monitor the motor position, if necessary.

While the sensor 63 and 64, which detects the light i3 and i4 in the instance described is a photodiode, other types of photosensitive sensor may be used. The photodiode 63 and 64 is connected to an amplifier of conventional type, the signal from which is passed through some form of filter selected to ensure that the important information is obtained from the sensor. A combination of analogue and digital methods is used in the instance described to provide the filtering function. The amplification and filtering functions are denoted by 63' and 64' in the figure. The algorithm which may be used to achieve the filtering function is described below.

If the area of measurement 58 and 58' on the yarn reserve is located at a sufficient distance from a pin:

Fire LED

Wait 50 microseconds

Close switch to feed sensor signal directly to filter

Wait (measurement time) microseconds

Extinguish LED

Wait 50 microseconds

Close switch to feed inverted sensor signal to filter

Wait (measurement time) microseconds

The measurement time specified above may typically be 100 microseconds. The time specified may vary somewhat depending on the value which affords the best and simplest measurement. The 50 microsecond waiting times shown are chosen to allow sufficient time for firing and extinguishing the LED completely before measurement is actually carried out. If the LED is extremely fast and the yarn is not self-illuminating, this time may be less than 1 microsecond. In this context, the most important factor is that the measurement time should be so short that the background light does not have sufficient time to vary in the course of the measuring sequence described above. For example, at extremely high speeds (30 revolutions per second), the time between two pins is 1280 microseconds, during which three measurements must be carried out, allowing for the fact that the pins themselves account for a proportion of the time. If a pin passes in 300 microseconds at this speed, the time remaining is 980 microseconds, corresponding to three intervals of 325 microseconds. In a measurement as described above, the chosen measurement time must be less than 113 microseconds or, if two measurements are to be carried out, less than 31 microseconds. These times may be subject to variation depending on a number of technical factors. For example, it may be possible to carry out both measurements concurrently if they do not interfere with each other or if measurements of the illuminated point are carried out individually, with concurrent measurement of the non-illuminated area at all points of measurement. The order of measurement may also be affected in those cases in which the points of measurement are not located in the same relationship to the pin. In this case, one or two points of measurement may be located opposite a pin while the others are located to the side. As the yarn wheel and pins rotate, it may be convenient to synchronized on the pin itself or on the reflective surfaces at the top of the wheel. Since the speed is relatively constant, it is possible, after synchronization, to define the measurement areas in time, enabling measurement to be carried out across several pins before resynchronization is required.

Slow variations in the background light can be eliminated by filtering as already described. Thus, the signal obtained is a measure of the light from the LED which is scattered back to the detector. The geometry of the optical system is such that only light which strikes the yarn should be detectable. Thus, the signal is a measure of the light from the yarn and will be zero if no yarn is present. The magnitude of the signal will increase with the size of the area covered by the yarn and the amount of light reflected by the yarn. In a case in which the signal is to be interpreted by a processor, it may be convenient to convert it into digital form with the aid of an analogue to digital (A/D) converter 68 and to determine whether or not yarn is present in the area of measurement by comparison with digitally stored reference values.

The signal from the photodiode amplifier may, in certain cases, or in parallel with the aforementioned filter, be connected to a comparator 71 which, in the case of certain processors, may be an integrated sub-function in 53. This is particularly suitable for the signal from the upper edge of the yarn wheel since this is normally used only to synchronize with certain fixed positions around the circumference. In the case in which a processor is used for control, the digital signal from the comparator is connected to a digital input 70 with an interrupt function which can resynchronize all other functions to the detected position of the yarn wheel. When a processor is used, the signal level to the comparator may be adjusted by means of an analogue output 72, which may be of the PWM type. This type of calibration is not required if the motor possesses a sufficient number of steps per revolution to afford satisfactory resolution. However, it may be considered as a complement to yarn monitoring, since this information can be used to ensure that motor synchronization with the rotating electrical field is not lost, causing the motor to stop.

The microprocessor 53 should preferably be a type in which most of the necessary components are integrated in one and the same circuit, such as an Hitachi H8/350, an NEC 78328, a Siemens SAB83C166 or equivalent from the same or other manufacturers. Units of this type are provided with RAM 55 and ROM 56, of which the ROM may be stitch-programmed or of the OTP, UVPROM or 'flash' type. Execution of the program stored in 56 is performed in 54, which communicates with memories and other units through a bus 53'. The type of processor circuit described also includes digital inputs 70, digital outputs 67, 69 and 76, analogue inputs 68 and analogue output 72. Since information exchange with 51 can take several forms, this unit 66 contains digital-type inputs and/or outputs or some type of serial data communication. The analogue output 72 may also be of the PWM type, which is digital in character but which, externally by means of a filter function, can replace a pure analogue output. The function of the circuit will not be described in detail since both it and its performance are described in suppliers' documentation. Some of the circuits described above are provided with outputs whose function is designed to control the current to the motors described in the foregoing. Normally, however, outputs of this type are provided only to control a single motor, whereas the arrangement described above incorporates two motors. As a result, one of the motors must be controlled with the aid of other outputs, in combination with software, to achieve the same function. Alternatively, the yarn feeder may be equipped with two processors or with an additional circuit 74 to control the motor 77 which, in turn, adjusts the length of the yarn 79. This enables the arm 78 to be used to perform rapid, short-term changes, with the motor 82 performing changes of a longer-term nature.

In modern yarn feeders, information exchange is normally achieved with the aid of a small number of digital conductors 81. Normally, however, the unit should deliver a signal to unit 51 when yarn breakage is detected so that the unit in question can be stopped and the fault corrected. The output of this type is normally of the 'open collector' type so that all units can perform this signalling function using one and the same conductor. In certain cases, the system may deliver a 'Run' signal indicating that the machine is running and, thereby, using yarn. Thus, the unit can use this signal to determine if there is a break in the yarn between the yarn wheel and machine by recording the yarn consumption from the wheel. Another signal which may be used is a synchronizing signal from the central control system when it is required to drive the unit motor synchronously at the machine speed. Normally, all of these signals are of the digital type with a voltage between 0 and 24 V; however, analogue signals and serial data communication may also be used to solve the same problem. On detecting a system fault, the unit should normally indicate the fault both by means of the signal described above and by means of some type of optical indication, such as an LED 73, enabling service personnel to locate the faulty unit (which may be one of ninety).

When the unit is equipped with data communication, it may be used for all data transmission. This means that the number of communication conductors is reduced to a two-way data channel. A data channel of this type may consist of a conductor in which the voltage is related to a common earth. However, two conductors driven by some type of standardized power stage, such as an RS-485 or ISO-11898, are used in most cases to achieve transmission which is immune to the electrical interference normally present in the environment. In some cases, the units may not be interconnected galvanically through the data communication function, this being achieved by the use of a transformer, optical switch or optic fibre between the units and/or between the unit and bus lead. The manner in which this is executed is known from the computer field, in which a similar system is used to achieve communication between computers of different types. In the event of yarn breakage, the system may be used to indicate not only the actual breakage, but which particular strand is broken.

Figure 6:
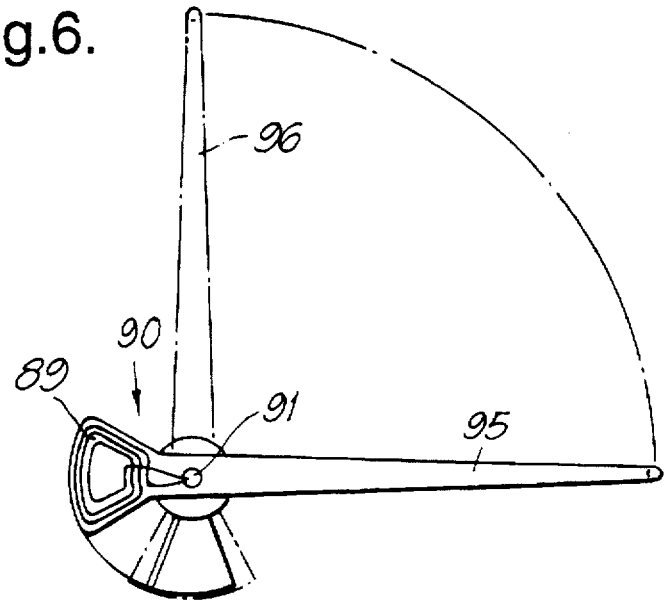
FIG. 6 and 6*a* are, respectively, top and side views, of another embodiment of a yarn gathering arm from a yarn feeding device according to the invention.
Figure 6A:
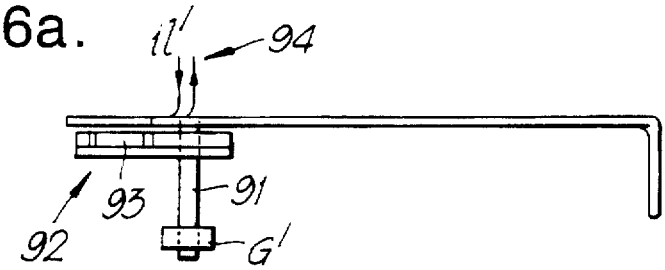

The aforementioned motor of the type used to position the reading head in a hard-disk drive is illustrated in FIG. 6 (horizontal view) and FIG. 6*a* (side view). The motor is provided with a winding 89 disposed at the pivoted end 90 of the arm. The arm is pivot-mounted on a spindle 91 with a magnetic device 93 in a housing 92. The power supply lead is indicated by 94. In FIG. 6, the arm is shown in a position 95 (solid outline) from which it may be pivoted to a position 96 (broken outline). The arm operates and is generally controlled as described above by means of signal(s) i1'. The sensor arrangement, consisting of one or more sensors G, G', is included for each motor used in the pivoting mechanisms as per FIGS. 2 and 6*a*.

In a further embodiment, the yarn demand in pattern knitting of frotté materials may vary, for example, from 1 m/s in the case of the plain sections to 8 m/s when knitting the frotté loops. An ideal method of dealing with these changes is to begin to accelerate the motor from low to high consumption immediately prior to the change and to allow the arm, as illustrated, for example, in FIGS. 6 and 6*a*, to establish a yarn reserve for use when the changeover commences. During this phase, before the motor has reached a steady high-consumption speed, the arm will return gradually to the original position and will supply yarn. By the time the arm has reached the original position, the motor will have reached the steady speed required by the new conditions. The opposite will occur on changing from high to low consumption. An example of this type of sequence, in which the pattern consists of 40 large and 40 small loops knitted alternately, is given below. In the context, this may be regarded as a difficult pattern.

Conditions

Low consumption: 1 m/s

High consumption: 8 m/s

The variation in yarn reserve is commenced 14 microseconds prior to the actual change in consumption.

No. of needle systems: 96

No. of needles per system: 27

No. of active needles: 13.5

Machine speed: 2 rad/s

Yarn feeder motor

Acceleration: 8000 rad/s

Max. speed: 310 rad/s

Min. speed: 0 rad/s

Spool dia.: 60 mm

Yarn reserve

Arm length: 70 mm

Max. yarn reserve: 150 mm

Figure 7:
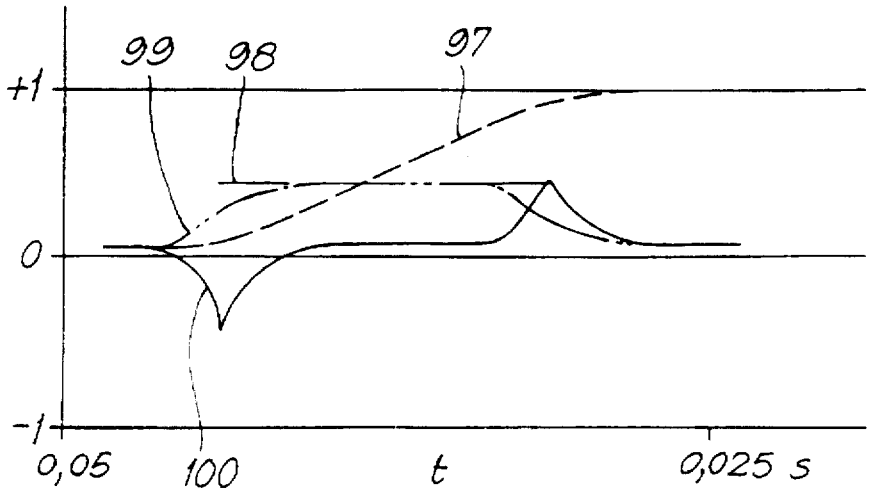
FIG. 7 is a graphical illustration of various yarn parameters versus time.

The total yarn consumption, yarn speed, size of the yarn reserve and total amount of yarn supplied are plotted in FIG. 7, in which the scales are chosen to show the clear time relationship. The yarn consumption 98 (in m/s) is plotted to a scale of 1:1, the yarn speed 99 (in m/s) to a scale of 1:10, the size of the yarn reserve 100 (in din) to a scale of 1:1 and the total quantity of yarn supplied 97 (in m) to a scale of 1:1. It is clear from the figure that, for example, the total yarn reserve required is approximately 90–100 min. The vertical axis gives the length and speed coordinates, while the time, ranging from 0.05 to 0.25 seconds, is plotted on the horizontal axis. The figures '+1' and '−1' are positions on the vertical axis, the figure '0' being an intermediate position.

The invention is not limited to the exemplified embodiment described above, but may be modified within the framework of the appended patent claims and invention concept.

I claim:

1. A yarn feeding device for a yarn-consuming textile machine, said yarn feeding device comprising:

a rotary yarn feeding element (1.83) for carrying a main yarn reserve (84) and for positively feeding yarn (79);

motor means (82) for rotating said yarn feeding element (1.83) during yarn feeding intervals said yarn feeding element normally delivers said yarn at at a motor rotation speed according to a predetermined variable yarn consuming speed of said textile machine;

yarn reserve means (3.78; 20, 77) for building up or reducing an auxiliary yarn reserve comprising a portion of said yarn between said textile machine and said main yarn reserve when changes of said yarn consuming speed occur that are so rapid that said motor means (82) cannot accordingly accelerate or decelerate said yarn feeding element (1.83) to deliver said yarn at said yarn consuming speed because of an inertia of said motor means and said yarn feeding element;

means (51.57.75) for controlling said motor means (82) when said changes of said yarn consuming speed occur according to predetermined yarn consuming speed information regarding timings of said changes and amounts of said yarn consumed by said textile machine before and after each of said changes so that said yarn feeding element (1.83) is accordingly accelerated or decelerated to increase or decrease said motor rotation speed and hence a speed at which said yarn is delivered from said yarn feeding element; and means for controlling said yarn reserve means (3.78; 20.77) to decrease or increase said portion of said yarn in said auxiliary yarn reserve so that also during accelerating or decelerating of said yarn feeding element said yarn is fed to said textile machine substantially at said predetermined variable yarn consuming speed in spite of said inertia of said motor means and said yarn feeding element.

2. The yarn feeding device as defined in claim 1, wherein said means for controlling said motor means accelerate said yarn feeding element prior to one of said changes in which said yarn consuming speed increases and said means for controlling said motor means decelerate said yarn feeding element prior to one of said changes in which said yarn consuming speed decreases.

3. The yarn feeding device as defined in claim 2, wherein said yarn reserve means comprises a braking element (36) on said yarn feeding element and wherein, when said new value of said yarn consuming speed is greater than said previous value, said means for controlling accelerates said yarn feeding element so that an acceleration of the yarn feeding element begins before and ends after said change and wherein said auxiliary yarn reserve comprises an additional quantity of said yarn on said yarn feeding element and said additional quantity of said yarn is built up on said yarn feeding element prior to said change by means of said braking element and is consumed after said change.

4. The yarn feeding device as defined in claim 2, wherein said yarn reserve means includes a braking element (36) on said yarn feeding element and wherein, when said new value of said yarn consuming speed is smaller than said previous value, said means for controlling decelerates said yarn feeding element so that a deceleration of the yarn feeding element begins before and ends after said change and wherein said auxiliary yarn reserve comprises an additional quantity of said yarn on said yarn feeding element and said additional quantity of said yarn is consumed prior to said change and is built up after said change by means of said braking element.

5. The yarn feeding device as defined in claim 1, wherein, if one of said changes occurs in which said yarn consuming speed is increased, said means for controlling said motor means includes means for beginning acceleration of said yarn feeding element prior to and ending said acceleration of said yarn feeding element after said change and wherein said auxiliary yarn reserve is built up before said change and delivered from said auxiliary yarn reserve to said textile machine after said change.

6. The yarn feeding device as defined in claim 1, wherein, if one of said changes occurs in which said yarn consuming speed is decreased, said means for controlling said motor means includes means for beginning deceleration of said yarn feeding element prior to said change and ending said deceleration of said yarn feeding element after said change and wherein said auxiliary yarn reserve is delivered to said textile machine before said change and said auxiliary yarn reserve is built up after said change.

7. The yarn feeding device as defined in claim 1, wherein said yarn reserve means includes a pivotally mounted element (3.78) interacting with said portion of said yarn being delivered to the textile machine by said yarn feeding element, and a yarn reserve motor (20.77) connected to said pivotally mounted element (3.78) for pivoting said pivotally mounted element (3.78) and for controlling said auxiliary yarn reserve.

8. The yarn feeding device as defined in claim 7, wherein during intervals of comparatively low yarn consumption by said textile machine said means for controlling said yarn reserve means puts said pivotally mounted element (3.78) in one predetermined position, for any of said changes during which said yarn consuming speed increases said means for controlling said motor means accelerates said yarn feeding element to an increased yarn consuming speed, and said means for controlling said yarn reserve means pivots said pivotally mounted element (3.78) to another predetermined position and then back to said one predetermined position, so that prior to said change said auxiliary yarn reserve is built up and after said change said auxiliary yarn reserve is delivered to said textile machine as said yarn feeding element reaches said increased yarn consuming speed.

9. The yarn feeding device as defined in claim 7, wherein during intervals of comparatively high yarn consumption by said textile machine said means for controlling said yarn reserve means puts said pivotally mounted element (3.78) in one predetermined position, for any of said changes during which said yarn consuming speed decreases said means for controlling said motor means decelerates said yarn feeding element to a decreased yarn consuming speed, and said means for controlling said yarn reserve means pivots said pivotally mounted element (3.78) to another predetermined position and then back to said one predetermined position so that prior to said change said auxiliary yarn reserve is delivered to said textile machine and after said change said auxiliary yarn reserve is again built up as said yarn feeding element reaches said decreased yarn consuming speed.

10. The yarn feeding device as defined in claim 7, wherein said yarn feeding element is a cylindrical spool body having a cylindrical yarn reserve surface, said pivotally mounted element (3.78) is pivotally mounted in the vicinity of a point (4) of intersection between two tangents of said yarn reserve surface (2) of said yarn feeding element, said two tangents being at right angles to each other, and said pivotally mounted element extends over said yarn feeding element and is formed to engage said portion of said yarn of said auxiliary yarn reserve.

11. The yarn feeding device as defined in claim 7, wherein said pivotally mounted element is mounted offset with respect to an axis of rotation of said yarn feeding element and is movable between two predetermined positions for building up and delivering said auxiliary yarn reserve, one of said two predetermined positions for pivoting said pivotally mounted element is clear of an outgoing yarn strand from said yarn feeding element and another of said two predetermined positions for positioning said pivotally mounted element is substantially at a right angle to a principal longitudinal direction of yarn feed.

12. A yarn feeding device for a yarn-consuming textile machine, said yarn feeding device comprising:

means for positively feeding yarn (79) to a textile machine to form a finished product according to a predetermined variable yarn consuming speed of the textile machine as determined by predetermined yarn consumption information including yarn consuming speed changes and timings of said yarn consuming speed changes, said means for positively feeding yarn (79) including a rotary yarn feeding element (1.83) for carrying a main yarn reserve (84), motor means (82) for rotating said rotary yarn feeding element (1,83) at a motor rotation speed according to said yarn consuming speed as determined by said predetermined yarn consumption information and means (51, 57) for controlling said motor means including microprocessor means for storing said predetermined yarn consumption information and for controlling the motor rotation speed according to said predetermined yarn consumption information, wherein said yarn feeding element (1,83) and said motor means (82) have an inertia limiting a rate at which said motor rotation speed can be changed;

yarn reserve means (3,78; 20, 77) for building up or reducing an auxiliary yarn reserve comprising a portion of said yarn extending between said main yarn reserve and said textile machine, when changes in said yarn consuming speed occur that are so rapid that said motor means (82) temporarily cannot change said motor rotation speed to deliver said yarn from said rotary yarn feeding element at said yarn consuming speed because of said inertia; and means for controlling said yarn reserve means (3,78; 20,77) to increase or decrease said portion of said yarn in said auxiliary yarn reserve so that, whenever said predetermined yarn consuming speed of said textile machine changes, said yarn is fed to said textile machine at said yarn consuming speed of said textile machine in accordance with said predetermined yarn consumption information in spite of said inertia of said motor means and said yarn feeding element.

13. The yarn feeding device as defined in claim 12, wherein said yarn reserve means includes a pivotally mounted element (3,78) interacting with said portion of said yarn and a yarn reserve motor (20,77) connected to said pivotally mounted element (3,78) for pivoting said pivotally mounted element (3,78) so as to increase or decrease said auxiliary yarn reserve, and said yarn reserve means and said yarn reserve motor have an inertia which is much less than said inertia of said yarn feeding element (1,83) and said motor means (82).

14. The yarn feeding device as defined in claim 12, wherein said auxiliary yarn reserve is an additional quantity of yarn on said yarn feeding element in addition to said main yarn reserve and said yarn reserve means includes means (36) for braking said yarn feeding element.

* * * * *